United States Patent [19]

Smith et al.

[11] Patent Number: 5,066,838

[45] Date of Patent: Nov. 19, 1991

[54] AUTOMOBILE BRAKE SWITCH ASSEMBLY

[75] Inventors: John W. Smith; Benjamin F. Chestnut, both of Indianapolis, Ind.

[73] Assignee: Emhart Industries, Inc., Farmington, Conn.

[21] Appl. No.: 472,723

[22] Filed: Jan. 31, 1990

[51] Int. Cl.[5] ..... H01H 3/14

[52] U.S. Cl. ..... 200/61.89

[58] Field of Search ..... 200/61.86, 61.87, 61.88, 200/61.89, 61.9, 61.91, 294, 295, 296

[56] References Cited

U.S. PATENT DOCUMENTS

| | | | |
|---|---|---|---|
| 4,170,723 | 10/1979 | Arsoy | 200/61.89 |
| 4,239,947 | 12/1980 | Breitung et al. | 200/61.89 |
| 4,316,065 | 2/1982 | Rupp et al. | 200/61.89 |
| 4,384,176 | 5/1983 | Chestnut | 200/1 A |

FOREIGN PATENT DOCUMENTS

| | | | |
|---|---|---|---|
| 3332545 | 4/1985 | Fed. Rep. of Germany | 200/61.89 |

*Primary Examiner*—J. R. Scott

*Attorney, Agent, or Firm*—Robert F. Meyer; Carl A. Forest

[57] ABSTRACT

An automobile brake switch assembly including a mounting clip and two brake switches, each brake switch including a threaded, cylindrical plunger housing. The mounting clip includes two hollow, cylindrical sleeves, each having an inner diameter slightly larger than the outer diameter of the threads on one of the brake switches. The sleeves are integrally molded, together with a plate that joins them, out of acetal plastic. Each sleeve includes a thread-like tooth molded about the inner circumference and located approximately centrally in the cylinder. Four slots are formed in each sleeve parallel to and spaced about the cylindrical axis, the slots cutting the tooth to form four teeth. The slots permit expansion of the teeth when the threaded plunger housing of the corresponding brake switch is pressed into the sleeve so that the threads may ratchet on the teeth. The teeth and inner surface of the sleeve mate with the threads to firmly hold the brake switch without pressing into the walls of the brake switch plunger housing. A pair of ears integrally formed with each sleeve are adapted to fit into notches in an automobile brake pedal bracket for attaching the assembly to the bracket.

7 Claims, 5 Drawing Sheets

AUTOMOBILE BRAKE SWITCH ASSEMBLY

BACKGROUND OF THE INVENTION

1. Field of the Invention

The invention in general relates to automobile brake switches and more particularly to mounting clip for mounting such switches in an automobile.

2. Description of the Prior Art

Switches that are activated by the brake mechanism of an automobile are well known in the art. Such switches generally comprise a housing which includes a switch housing and a barrel-like plunger housing, a plurality of switches in the switch housing chamber, and a plunger movable in the plunger housing barrel. The plunger is driven by the brake mechanism to operate the switches. See, for example, U.S. Pat. No. 4,384,176 issued on an invention of Benjamin F. Chestnut. In the above patent, the switches are electrical switches. It is also known to use the plunger to activate a vacuum driven system. Such switches operated to open and close a vent to a vacuum line. Generally an automobile brake system will include both electrical and vacuum switches since the vacuum switch offers a mechanical alternative that can operate if the electrical system fails.

The above brake switches are generally mounted in automobiles by threading the plunger housing barrel, screwing the plunger housing into a mounting clip, and mounting the mounting clip on the brake pedal bracket of the automobile. The mounting clips in the prior art have generally been made of metal or some other material which is suitable for making strong leaf type springs. The clips comprise a base member and three or more opposed spring jaws with teeth-like distal ends that press down on the threads. This structure enables the housings to be adjusted by turning the housing and screw threads, or by pressing the housing so that the spring jaws spread and permit the switch to be ratcheted to the desired position. The ratcheting allows the switch mounting to be self adjusting. That is, the switches are first fully mounted to the brake pedal bracket with the brake pedal pressed down. The brake pedal is then released and the brake lever pushes against the plunger, pressing it all the way into the barrel of its housing, then ratcheting the plunger housing barrel through the mounting clip jaws until the brake lever hits its stop. The switches then activate properly when the brake pedal is again pushed to release the plunger. Since the brake lever acts with considerable force and the switch must remain stationary for hundreds of thousands of brake lever movements over a period of many years, the spring jaws must have powerful springs. Unfortunately, such powerful springs acting on the plunger housings over long periods, often cause the plunger housing barrels to deform. This generally results in switch sticking or failure. Modern automobile have many different functions that operate off of the brake, lever. These may include the clutch torque converter, the anti-lock braking system, the cruise control, the shift interlock, the stoplights, and redundant systems for any of the above. Thus it would be useful if the mounting clip would lend itself to mounting of a plurality of switches.

SUMMARY OF THE INVENTION

It is an object of the invention to provide an automobile vacuum brake switch assembly that overcomes one or more of the disadvantages of the prior art switches.

It is another object of the invention to provide an automobile brake switch assembly that is highly reliable over a long lifetime.

It is a further object of the invention to provide an automobile brake switch assembly that holds the switches firmly, permits a ratcheting action, and at the same time does not press in on the plunger housings.

It is still another object of the invention to provide automobile brake switch assembly that lends itself to mounting a plurality of switches at a time.

The invention provides an automobile brake switch assembly comprising: a mounting clip; first brake switch means comprising: a first switch housing having a hollow first plunger housing; one or more switches enclosed in the switch housing; a first plunger slidable within the first plunger housing; the exterior of the plunger housing having first thread means for connecting the first switch housing to the mounting clip; second brake switch means comprising: a second switch housing having a hollow second plunger housing; one or more switches enclosed in the second switch housing; a second plunger slidable within the second plunger housing; the exterior of the second plunger housing having second thread means for connecting the second switch housing to the mounting clip; and the mounting clip comprising: first ratchet means for engaging the first thread means on the first plunger chamber sufficiently firmly to prevent movement of the first plunger housing with respect to the mounting clip while the first plunger is moving in the first plunger housing and sufficiently loosely to allow ratcheting movement of the first plunger housing with respect to the mounting clip when the brake mechanism pressure is exerted on the first plunger housing, and without exerting force on the first plunger housing, in a direction perpendicular to the direction of movement of the first plunger, sufficient to deflect the walls of the first plunger housing; second ratchet means for engaging the second thread means on the second plunger housing sufficiently firmly to prevent movement of the second plunger housing with respect to the mounting clip while the second plunger is moving in the second plunger housing and sufficiently loosely to allow ratcheting movement of the second plunger housing with respect to the mounting clip when the brake mechanism pressure is exerted on the second plunger housing, and without exerting force on the second plunger housing, in a direction perpendicular to the direction of movement of the second plunger, sufficient to deflect the walls of the second plunger housing; and means for fastening the mounting clip to an automobile so that the automobile brake mechanism engages the first and second plungers. Preferably, the first plunger housing is cylindrical and the first ratchet means comprises: a first hollow cylindrical means for receiving the first plunger housing; and first tooth means formed on the interior wall of the first hollow cylindrical means; and the second plunger housing is cylindrical and the second ratchet means comprises: second hollow cylindrical means for receiving the second plunger housing; and second tooth means formed on the interior wall of the second hollow cylindrical means. Preferably, the first hollow cylindrical means comprises a hollow first cylinder having at least one first opening formed in its wall, the first opening being elongated in the direction of the cylindrical axis of the first cylinder; and the second hollow cylindrical means comprises a hollow second cylinder having at least one second opening formed in its wall, the second opening being elongated in the direction of the cylindrical axis of the second cylinder. Preferably there are a plurality of the first openings and each of the first openings cuts the first tooth means thereby forming a plurality of first teeth and permitting the first teeth to move outward sufficiently to permit ratcheting movement of the first thread means with respect to the first teeth; and there are a plurality of the second openings and each of the second openings cuts the second tooth means thereby forming a plurality of second teeth and permitting the second teeth to move outward sufficiently to permit ratcheting movement of the second thread means with respect to the second teeth. Preferably, the means for fastening comprises means for fastening the mounting clip to an automobile in a single motion. Preferably, the mounting clip is integrally molded out of acetal plastic.

The invention not only provides an automobile brake switch assembly that is reliable and has a long life, but the assembly is also easier to install than prior art switch assemblies, permitting several switches to be installed without separate fasteners and in a single motion. Numerous other features, objects, and advantages of the invention will now become apparent from the following detailed description when read in conjunction with the drawings.

DESCRIPTION OF THE PREFERRED EMBODIMENT

Figure 1:
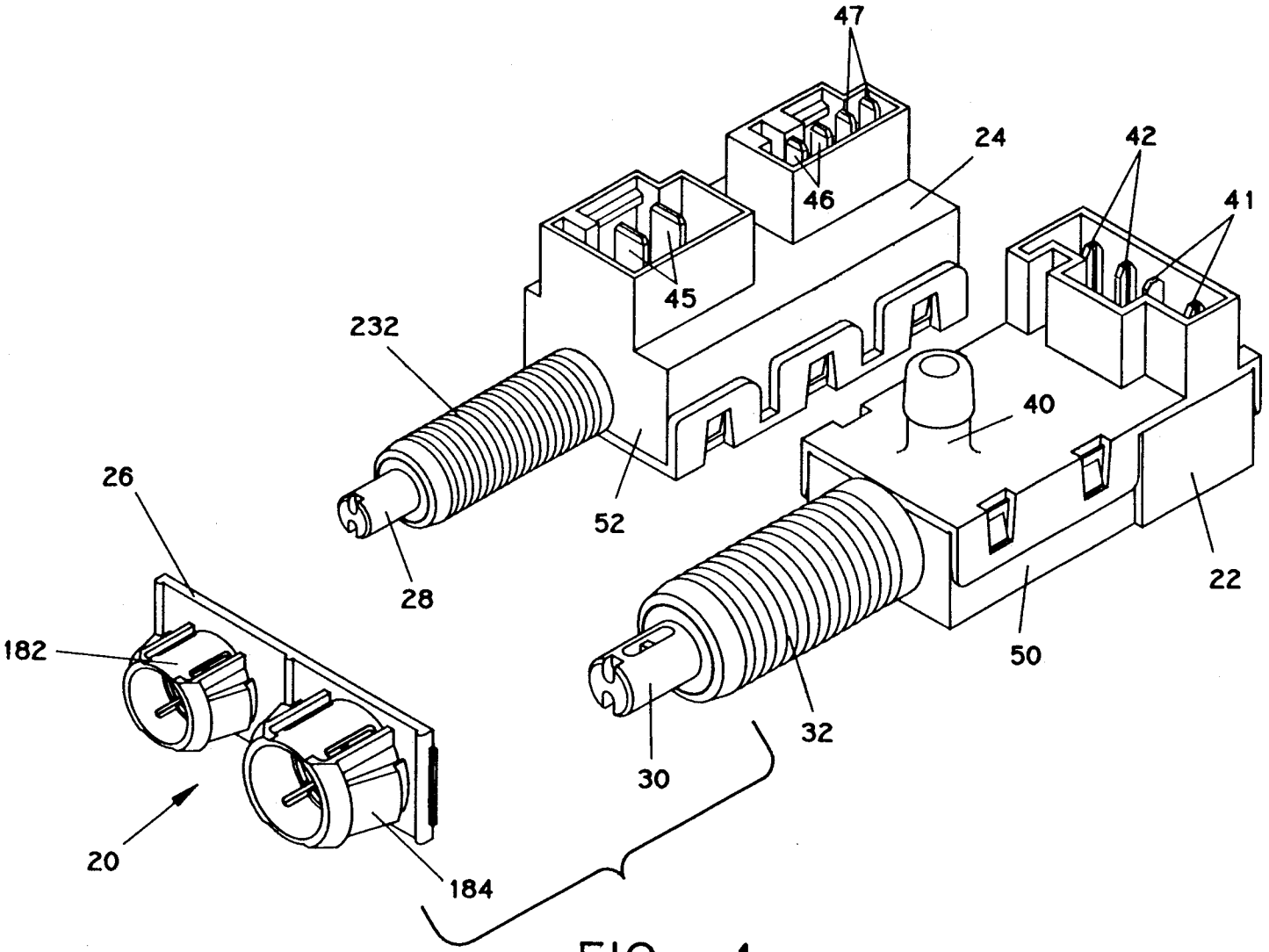
FIG. 1 is an exploded view of the automobile brake switch assembly according to the invention.

Directing attention to FIG. 1, there is shown an exploded, perspective view of an automobile brake switch assembly 20. The assembly 20 includes vacuum brake switch 22 and triple-acting switch 24 which will not be discussed in detail herein. It also includes mounting clip 26 which will be discussed in detail below. It should be understood that the embodiment described herein is exemplary, is for purposes of illustration only, and is not intended to be limiting of the invention. The brake switches 22 and 24 are mounted in mounting clip 26 which is in turn mounted in a panel of an automobile so that the brake lever (not shown) connected to a foot brake (not shown) acts on plungers 28 and 30. Vacuum brake switch includes a first switch housing 50 including a first plunger housing 32. First switch housing 50 contains a vacuum switch 40 and two electrical switches 41 and 42. Triple-acting switch 24 includes a second switch housing 52 including a second plunger housing 232. Second switch housing 52 contains three electrical switches 45, 46, and 47. The details of these switches are not pertinent to the invention.

Figure 2A:
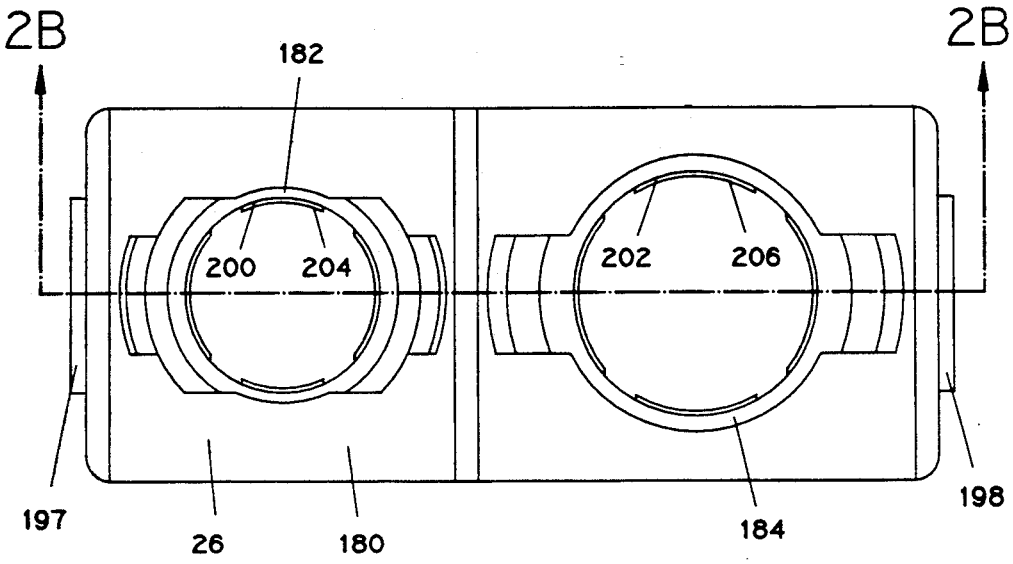
FIG. 2A shows a front plan view of the mounting clip of FIG. 1.
Figure 2B:
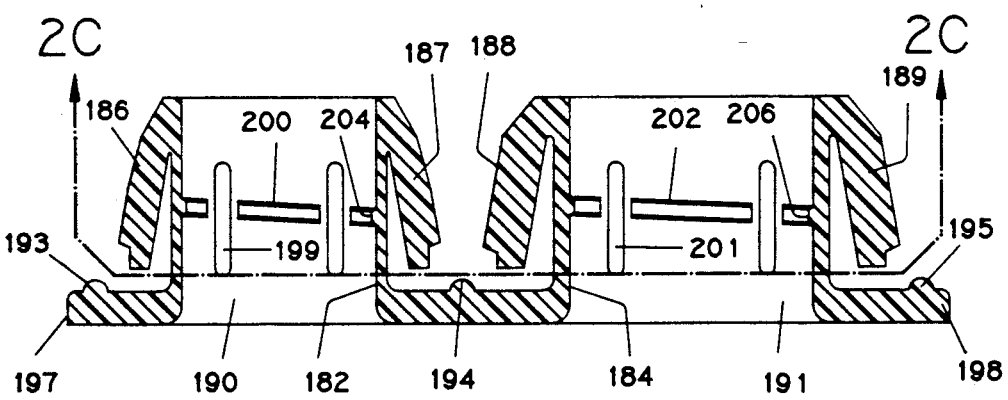
FIG. 2B is a cross-sectional view taken through lines 2B—2B of FIG. 2A.
Figure 2C:
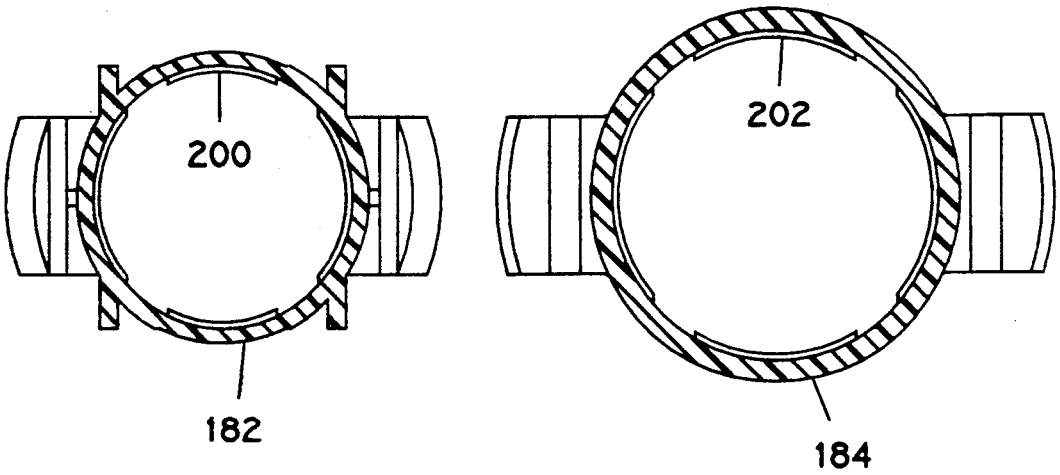
FIG. 2C is a cross-sectional view taken through lines 2C—2C of FIG. 2B.
Figure 2D:
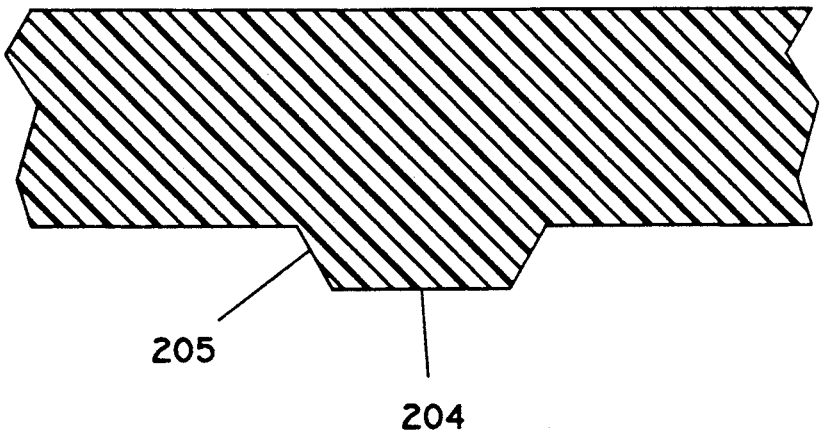
FIG. 2D is a detail of portion of FIG. 2B showing a tooth of the mounting clip of FIG. 2A.

Turning now to a detailed description of mounting clip 26 shown in FIGS. 2A through 2D. Mounting clip 26 includes plate 180, hollow cylindrical sleeves 182 and 184, and locking ears 186, 187, 188, and 189. The bores 190 and 191 of sleeves 182 and 184 respectively pass through plate 180 also. Plate 180 is rectangular, preferably about 0.950 inches by 2.195 inches, and has three semi-cylindrical ribs 193, 194, and 195, of about 0.065 inches diameter, running across the narrower dimension on the front surface, ribs 193 and 195 at each of the two ends and rib 194 between sleeves 182 and 184. Flanges 197 and 198 extend about 0.04 inches from either end. Sleeve 182 is about 0.502 inches inner diameter and 0.555 inches outer diameter in the vertical direction in FIG. 2C and 0.565 inches in the horizontal direction, while sleeve 184 is about 0.628 inches inner diameter and 0.710 inches outer diameter. Each sleeve 182 and 184 has four slots, such as 199, that are each about 0.040 inches wide by 0.165 inches long with radiused ends. The slots, such as 199, in sleeve 182 are spaced about 0.125 inches from the vertical centerline of the sleeve in FIG. 2B, and the slots, such as 201, in sleeve 184 are spaced about 0.175 inches from the vertical centerline of sleeve 184 in the same FIG. Each sleeve 182 and 184 has a tooth 200 and 202 respectively which is broken into four teeth by the slots. Each tooth 200, 202 is formed about the inner circumference of the respective sleeve 182, 184, following an appropriate line to mate with the threads 240, 78 on plunger housings 232 and 32 respectively, and approximately centrally located with respect to the ends of the sleeve. Surface 204 has a diameter of about 0.478 inches. The shape of tooth 200 is shown in FIG. 2D. It is about 0.030 inches wide (the horizontal direction in FIG. 2D) and the edges, such as 205 slope at 60 degrees. Surface 206 of tooth 202 has a diameter of 0.604 inches and a width of 0.034 inches with the sides sloped at the same 60 degree angle. Ear 186 is about 0.088 inches thick at its thickest point and its outer and inner surfaces slope at about 15 degrees and 10 degrees respectively from the vertical, and ear 187 is similar. Ear 188 has the same slopes but is about 0.112 inches thick at its thickest point.

Figure 3:
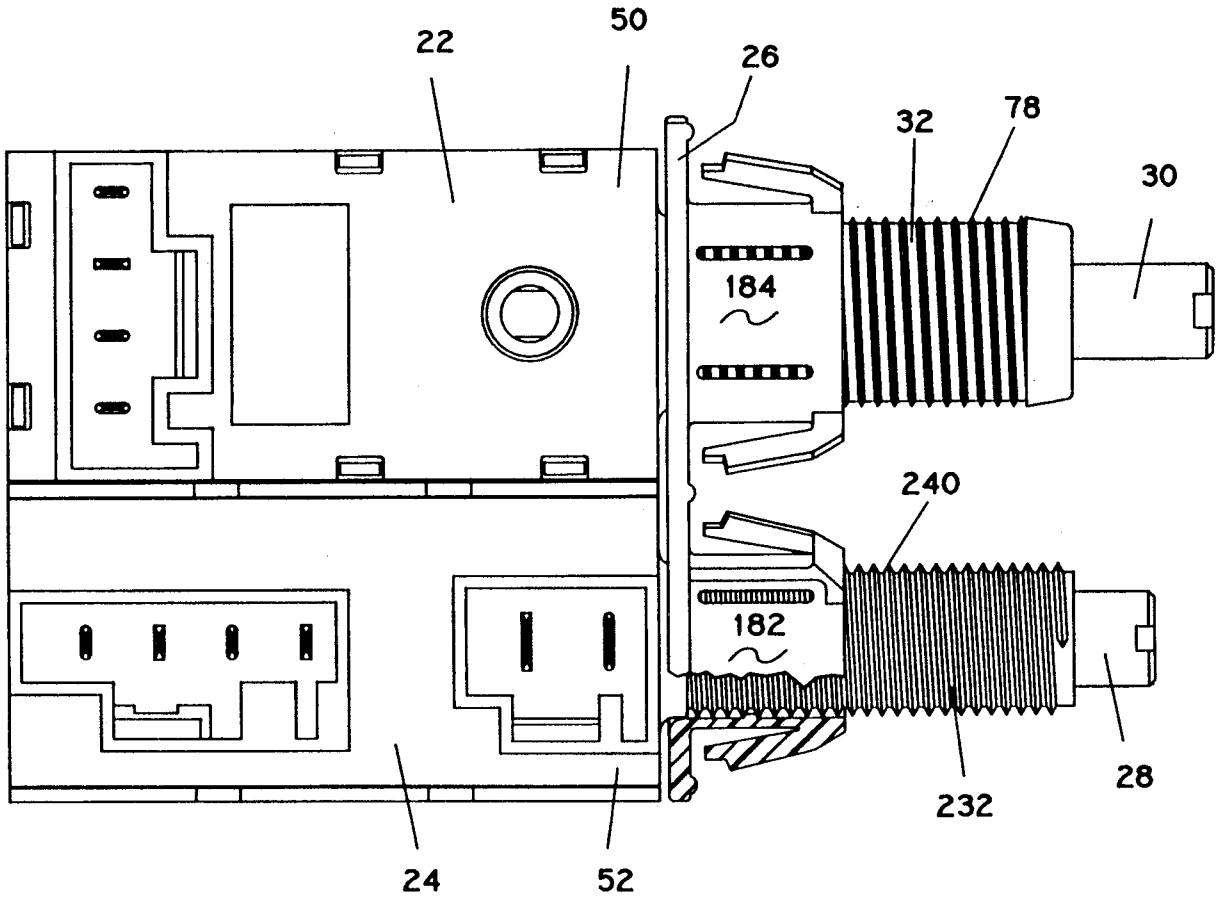
FIG. 3 shows a partially cut away top plan view of the assembled automobile brake switch assembly of FIG. 1.
Figure 4:
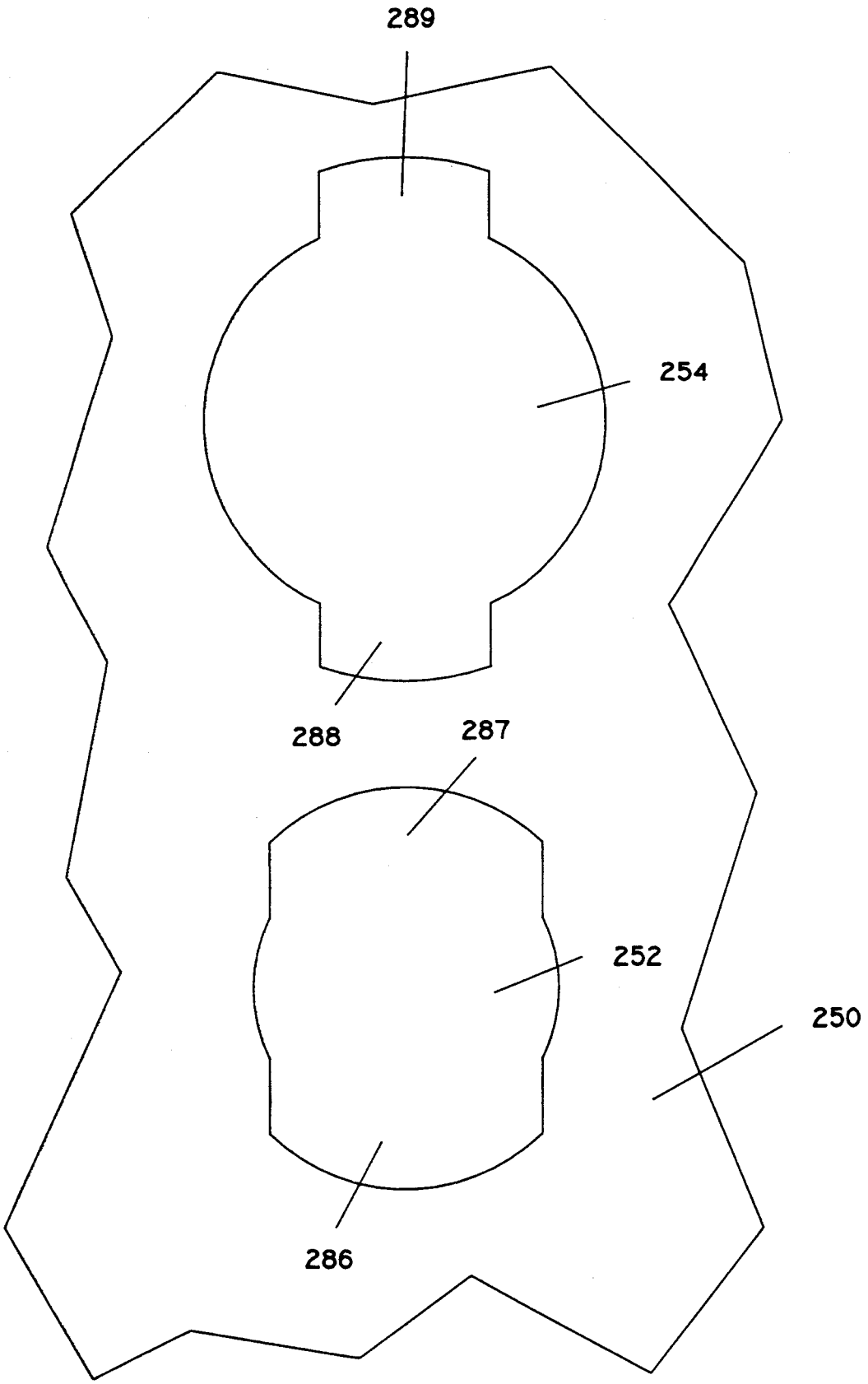
FIG. 4 shows the mounting holes in a brake pedal bracket of an automobile in which the the assembly of FIG. 3 may be mounted.

FIG. 3 shows vacuum switch 22 and triple acting switch 24 mounted in mounting clip 26. The first plunger housing 32 of vacuum switch 22 has a $\frac{5}{8}$-18 UNF 2A thread 78 while the second plunger housing 232 of triple acting switch 24 has a $\frac{1}{2}$-20 UNF 2A thread 240. FIG. 4 shows brake pedal bracket 250 of an automobile on which the mounting clip 26 holding switches 22 and 24 may be mounted. It contains holes 252 and 254. Hole 252 is shaped for receiving sleeve 182, with ears 186 and 187 snapping into notches 286 and 287 respectively, and hole 254 is shaped for receiving sleeve 184 with ears 188 and 189 snapping into notches 288 and 289 respectively.

Vacuum switch 22 and triple acting switch 24 are preferably mounted in an automobile as follows. First plunger housing 32 of vacuum switch 22 is screwed into sleeve 184 while second plunger housing 232 of triple acting switch 24 is screwed into sleeve 182. Alternatively, the plunger housings 32 and 232 may be pressed into sleeves 184 and 182 respectivly with the slots, such as 199 and 201, permitting the sleeves to expand sufficiently to permit threads 78 to ratchet on teeth 202 and threads 248 to ratchet on teeth 200. The plunger housings 32 and 232 are preferably threaded or pressed all the way into their respective sleeves 184 and 182 respectively as shown in FIG. 3. With the brake pedal (not shown) pressed down, the mounting clip 26 is then pressed into the bracket 250 of the automobile. This may be done in a single forward motion. The brake pedal (not shown) is then released and the brake lever (not shown) to which it is attached presses against plungers 28 and 30, pressing them all the way into their respective housings 32 and 232 and then ratcheting the plunger housings 32 and 232 partially through sleeves 184 and 182 respectively until the brake lever hits its stop. The switches 22 and 24 will then activate properly when the brake pedal is again pushed.

Preferably the switches 41, 42, 45, 46, and 47 are made of brass, preferably 260 CDA, half hard. Switch housings 50 and 52 including plunger housings 32 and 232 are preferably made of Nylon 6/6 with 0–15% glass, 25%–40% mineral filled. Plunger 30 is made of any suitable hard plastic with lubricity, such as teflon filled nylon. Mounting clip 26 is preferably made of acetal plastic. The mounting clip 26, housings 50 and 52, and plungers 28 and 30 are preferably each integrally molded.

It is a feature of the invention that teeth 200 and 202 do not press into threads 240 and 78 and yet plunger housings 232 and 32 are firmly gripped by the clip 26. This is possible because the inner diameter of sleeves 182 and 184 is just a few hundredths of an inch larger than the outer diameter of the threads 240 and 78 of the respective plunger housings 232 and 32 and thus substantial support is provided by sleeves 182 and 184 as well as the teeth 200 and 202.

A novel automobile brake switch assembly that is highly reliable, has a long lifetime, and has numerous other advantages has been described. It is evident that those skilled in the art may now make many changes in the assembly as described without departing from the inventive concepts. For example equivalent materials and parts may be used. Additional mounting sleeves and switches may be added. The parts may take on many different shapes and dimensions. Thus the invention should be construed as embracing each and every novel feature and novel combination of features present in and possessed by the invention described.

What is claimed is:

1. An automobile brake switch assembly comprising:

a mounting clip;

first brake switch means carried by said mounting clip comprising: a first switch housing having a hollow first plunger housing; one or more electrical switches enclosed in said switch housing; a first plunger slidable within said first plunger housing; the exterior of said plunger housing having first thread means for connecting said first switch housing to said mounting clip;

second brake switch means carried by said mounting clip comprising: a second switch housing having a hollow second plunger housing; one or more electrical switches enclosed in said second switch housing; a second plunger slidable within said second plunger housing; the exterior of said second plunger housing having second thread means for connecting said second switch housing to said mounting clip; and said mounting clip comprising:

first ratchet means for engaging said first thread means on said first plunger housing sufficiently firmly to prevent movement of said first plunger housing with respect to said mounting clip while said first plunger is moving in said first plunger housing and sufficiently loosely to allow ratcheting movement of said first plunger housing with respect to said mounting clip when brake mechanism pressure is exerted on said first plunger housing during mounting of said mounting clip to an automobile, and without exerting force on said first plunger housing, in a direction perpendicular to the direction of movement of said first plunger, sufficient to deflect the walls of said first plunger housing;

second ratchet means for engaging said second thread means on said second plunger housing sufficiently firmly to prevent movement of said second plunger housing with respect to said mounting clip while said second plunger is moving in said second plunger housing and sufficiently loosely to allow ratcheting movement of said second plunger housing with respect to said mounting clip when brake mechanism pressure is exerted on said second plunger housing during mounting of said mounting clip to an automobile, and without exerting force on said second plunger housing, in a direction perpendicular to the direction of movement of said second plunger, sufficient to deflect the walls of said second plunger housing; and said mounting clip including means for fastening said mounting clip to an automobile so the the automobile brake mechanism engages said first and second plungers.

2. An automobile brake switch assembly as in claim 1 wherein:

said first plunger housing is cylindrical and said first ratchet means comprises: a first hollow cylindrical means for receiving said first plunger housing; and first tooth means formed on the interior wall of said first hollow cylindrical means; and said second plunger housing is cylindrical and said second ratchet means comprises: second hollow cylindrical means for receiving said second plunger housing; and second tooth means formed on the interior wall of said second hollow cylindrical means.

3. An automobile brake switch assembly as in claim 2 wherein:

said first hollow cylindrical means comprises a hollow first cylinder having at least one first opening formed in its wall, said first opening being elongated in the direction of the cylindrical axis of said first cylinder; and said second hollow cylindrical means comprises a hollow second cylinder having at least one second opening formed in its wall, said second opening being elongated in the direction of the cylindrical axis of said second cylinder.

4. An automobile brake switch assembly as in claim 3 wherein:

there are a plurality of said first openings and each of said first openings cuts said first tooth means thereby forming a plurality of first teeth and permitting said first teeth to move outward sufficiently to permit ratcheting movement of said first thread means with respect to said first teeth; and there are a plurality of said second openings and each of said second openings cuts said second tooth means thereby forming a plurality of second teeth and permitting said second teeth to move outward sufficiently to permit ratcheting movement of said second thread means with respect to said second teeth.

5. An automobile brake switch assembly as in claim 1 wherein said means for fastening comprises means for fastening said mounting clip to an automobile in a single motion.

6. An automobile brake switch assembly as in claim 1 wherein said mounting clip is integrally molded out of plastic.

7. An automobile brake switch assembly as in claim 6 wherein said plastic is acetal plastic.

* * * * *